US005572875A

United States Patent [19]

Gustafson

[11] Patent Number: 5,572,875

[45] Date of Patent: Nov. 12, 1996

[54] RELIEF VALVE CONSTRUCTION TO MINIMIZE IGNITION HAZARD FROM CRYOGENIC STORAGE TANKS CONTAINING VOLATILE LIQUIDS

[75] Inventor: Keith W. Gustafson, Waleska, Ga.

[73] Assignee: Minnesota Valley Engineering, Inc., New Prague, Minn.

[21] Appl. No.: 234,129

[22] Filed: Apr. 28, 1994

[51] Int. Cl.[6] ..... F17C 7/04; F17C 9/02

[52] U.S. Cl. ..... 62/48.1; 62/50.1

[58] Field of Search ..... 62/48.1, 50.1

[56] References Cited

U.S. PATENT DOCUMENTS

| | | | |
|---|---|---|---|
| 3,123,981 | 3/1964 | Carney et al. | 62/48.1 |
| 3,298,187 | 1/1967 | Short | 62/48.1 |
| 3,548,856 | 12/1970 | Vant | 62/48.1 |
| 3,608,324 | 9/1971 | Singleton et al. | 62/48.1 |
| 3,690,115 | 9/1972 | Clayton | 62/48.1 |
| 3,842,613 | 10/1974 | Becker | 62/48.1 |
| 4,350,017 | 9/1982 | Kneip et al. | 62/48.1 |

*Primary Examiner*—Ronald C. Capossela
*Attorney, Agent, or Firm*—Rockey, Rifkin and Ryther

[57] ABSTRACT

A combined second relief valve and restricted orifice is located downstream of the relief valve stack on a vent line. The second relief valve opens at a pressure greater than that of the relief stack. When the second relief valve is closed, vapor is vented through the restricted orifice at high velocity, and when the second relief valve is open, the vapor vents from the unrestricted end of the vent line at high volume.

13 Claims, 2 Drawing Sheets

RELIEF VALVE CONSTRUCTION TO MINIMIZE IGNITION HAZARD FROM CRYOGENIC STORAGE TANKS CONTAINING VOLATILE LIQUIDS

BACKGROUND OF THE INVENTION

The invention relates, generally, to LNG powered vehicles and, more particularly, to a relief valve jet to minimize the ignition hazard from such vehicles.

In recent years numerous advances have been made in developing alternative fuels for powering vehicles. One alternative fuel, liquified natural gas (LNG), has proven to be one of the more promising and widely accepted alternative fuels and is presently being tested and used on vehicles such as city bus fleets.

The use of LNG as a motor vehicle fuel has numerous advantages over gasoline and other alternative fuels. LNG is low cost, clean burning, widely available domestically, non-contaminating in spills and has a high energy density and high ignition temperature. One problem with LNG is that it is a cryogenic liquid, i.e., a gas that exists as a liquid only at extremely low temperatures. As a result, if a fuel tank filled with LNG is allowed to sit without being used, heat will be transferred to the LNG causing it to vaporize and build pressure in its tank. To regulate the pressure in the tank the vaporized natural gas is eventually vented to the atmosphere. As a result, vehicles that are powered by LNG include a vent stack for venting the vaporized natural gas to the atmosphere.

While venting itself is not hazardous, natural gas is highly flammable and presents a fire hazard at the vent stack where open flames or sparks in the vicinity of the vent stack can ignite the venting gas. Additionally, there is the possibility, when venting indoors, for example in bus terminals, for the methane rich natural gas to pool at the building ceiling and be ignited by lights or ventilators. Obviously, these conditions present an undesirable safety hazard.

Thus, an improved vent system for LNG powered vehicles is desired.

SUMMARY OF THE INVENTION

One contributing factor for the above-described safety hazard is that the vent stack must be dimensioned to be able to accommodate a worst case vent scenario. For example, vent stacks are typically sized to vent an uninsulated tank in a fire. As a result, vent stacks are designed with a large line size compared to that required for normal relief of the product. Because of the large vent lines, the velocity of the gas exiting the vent stack at normal relief flow rates is relatively low such that the gas can ignite and burn.

The present invention utilizes the discovery that as the size of the opening of the vent stack is made smaller, the velocity of the vented gas is increased. The gas velocity will eventually reach a speed where the velocity of the venting gas exceeds the flame propagation rate of the gas, while simultaneously entraining enough air in the escaping gas by the time it slows to become nonflammable. In other words, natural gas and other cryogenic fluids, vented at high speed, will be self-extinguishing.

This arrangement has two safety advantages. First, once the source of ignition is removed from the jet of gas, the flame will be immediately extinguished. Second, the escaping high velocity gas will be thoroughly mixed with air and will be below its lower flammability limit such that subsequent contact with an ignition source, such as building ventilators or lights, will not cause ignition.

To practice the invention, a restricted orifice or jet of relatively small diameter is located at the end of the relief valve stack. The orifice is sized to create a velocity for the venting gas sufficient to create the self-extinguishing conditions set forth above. To preserve the tank safety features for worst case venting conditions, an additional vent path is provided to accommodate high volume emergency venting. A pressure difference is created between the high velocity vent line and the high volume emergency line such that the high velocity vent line will normally vent gas and the high flow line will vent only when the pressure in the system reaches a predetermined upper limit.

DETAILED DESCRIPTION OF THE INVENTION

Figure 1:
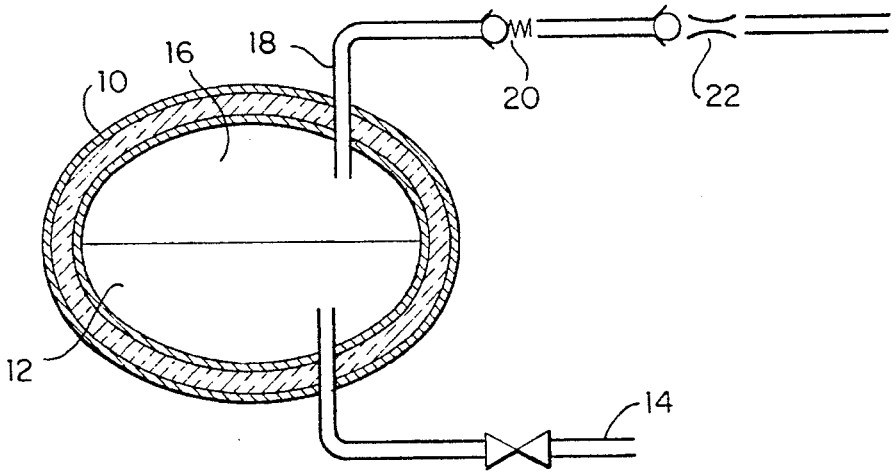
FIGS. 1 through 3 show various embodiments for the arrangement of the high velocity vent line and the high volume emergency relief.

Referring more particularly to FIG. 1, a preferred embodiment of the invention is illustrated and consists of tank 10 holding a quantity of LNG 12. The LNG is delivered to a use device such as the vehicle engine by gas use line 14. The tank 10 typically consists of a double-walled, vacuum insulated design to minimize heat transfer to the LNG although any suitable tank design can be used. Although tank 10 is insulated, heat will slowly be transferred to the LNG such that the LNG will vaporize to create a head 16 of natural gas.

As more LNG is vaporized, the pressure of head 16 will gradually increase. If the pressure in the system is not lowered sufficiently by periodic use of the product, some of the natural gas in tank 10 will be vented to the atmosphere, thereby to lower the pressure in the system. In a preferred embodiment, tank 10 is the on-board fuel tank of an LNG powered vehicle such as a bus or the like; however, the vent system can be used with other cryogenic storage systems.

Single vent line 18 includes relief valve 20 that opens at a first pressure $R_1$. A combined second relief valve and restricted orifice 22 is also located in line 18 downstream of relief valve 20. The second relief valve opens at a second pressure $R_2$ greater than $R_1$. When the second relief valve is closed, vapor is vented only through the restricted orifice at high velocity. When the second relief valve is open, the vapor vents from the unrestricted end of line 18 at high volume.

Figure 2:
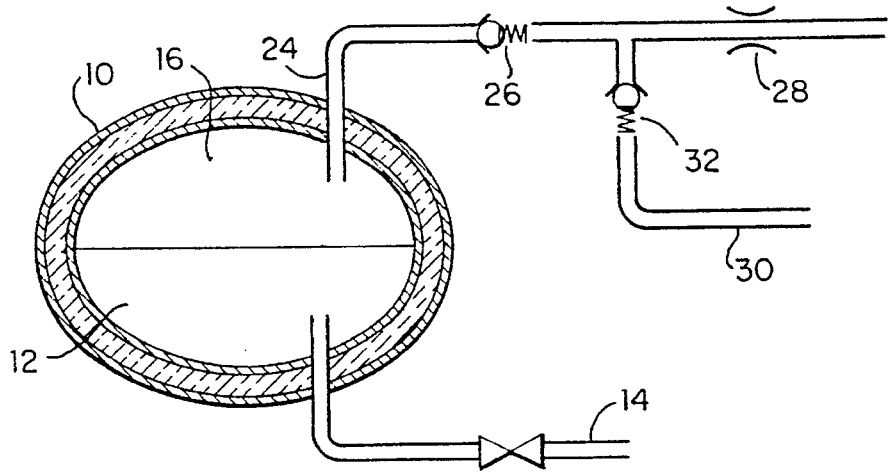

An alternate embodiment of the invention is shown in FIG. 2 where a main vent line 24 is connected to the gas head 16 of tank 10 and includes relief valve 26 and restricted orifice 28. Relief valve 26 opens at a first pressure $R_1$. A second line 30 taps into main vent line 24 between the relief valve 26 and restricted orifice 28. The second line 30 includes second relief valve 32 that opens at a second pressure $R_2$ that is higher than the first pressure $R_1$. The embodiment of FIG. 2 operates in substantially the same manner as the embodiment of FIG. 1.

Figure 3:
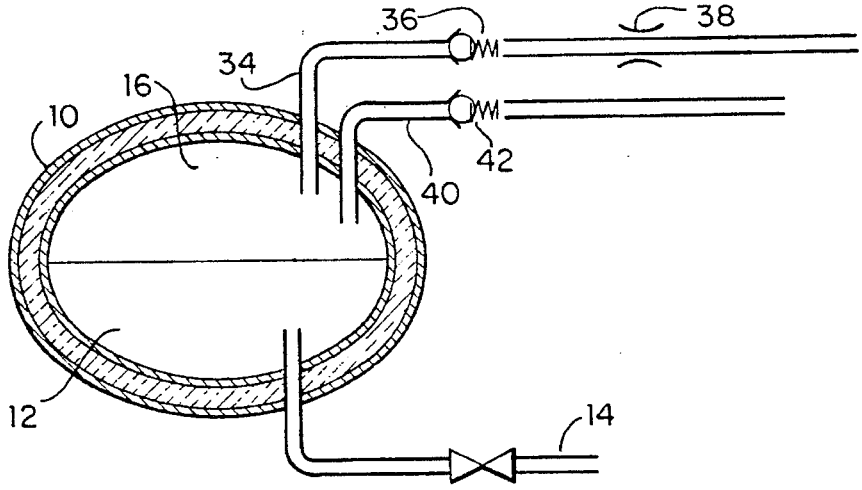

Another alternate embodiment of the invention is shown in FIG. 3 where a first vent line 34 connects gas head 16 to the external environment. Vent line 34 is used to vent natural gas during normal operation of the tank and includes a relief valve 36 that opens at a pressure greater than the pressure needed at the use device (i.e., the pressure required by the vehicle engine) but less than the pressure at which emergency, high volume venting is required. the pressure at which valve 36 opens is designated $R_1$.

Line 34 further includes a restricted orifice or nozzle 38 at the end thereof. The sizing of nozzle 38 is selected to create a gas exit velocity great enough to prevent ignition as will hereinafter be explained.

A second vent line 40, the high volume emergency relief line, also connects pressure head 16 to the external environment. A second relief valve 42 is provided in line 40 that opens at a pressure greater than the pressure at which relief valve 36 opens but low enough to vent gas from tank 10 before it builds to dangerous or undesirable levels. The pressure at which relief valve 42 will allow venting of gas is designated $R_2$, $R_2$ being greater than $R_1$. The embodiment of FIG. 3 operates in substantially the same manner as the embodiment of FIGS. 1 and 2.

It should be noted that line 40 does not include a restricted orifice or nozzle at its end such that the gas will be vented at a relatively low velocity but at high volume. Thus, when relief valve 40 is opened, the pressure in tank 10 can be quickly lowered. The difference in pressure between the pressure required to open relief valve 36 and the pressure required to open relief valve 42 is the delta pressure ($\Delta P$) where $\Delta P=R_2-R_1$.

Figure 4:
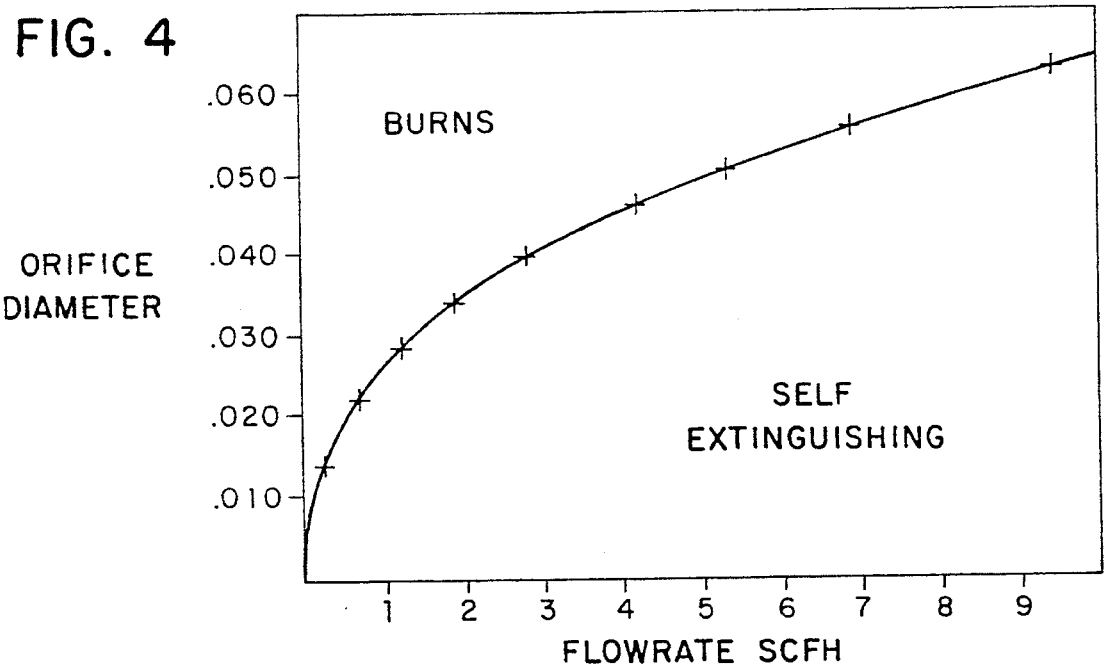
FIGS. 4 and 5 are graphs used to explain how the design parameters for the vent system of the invention are determined.
Figure 5:
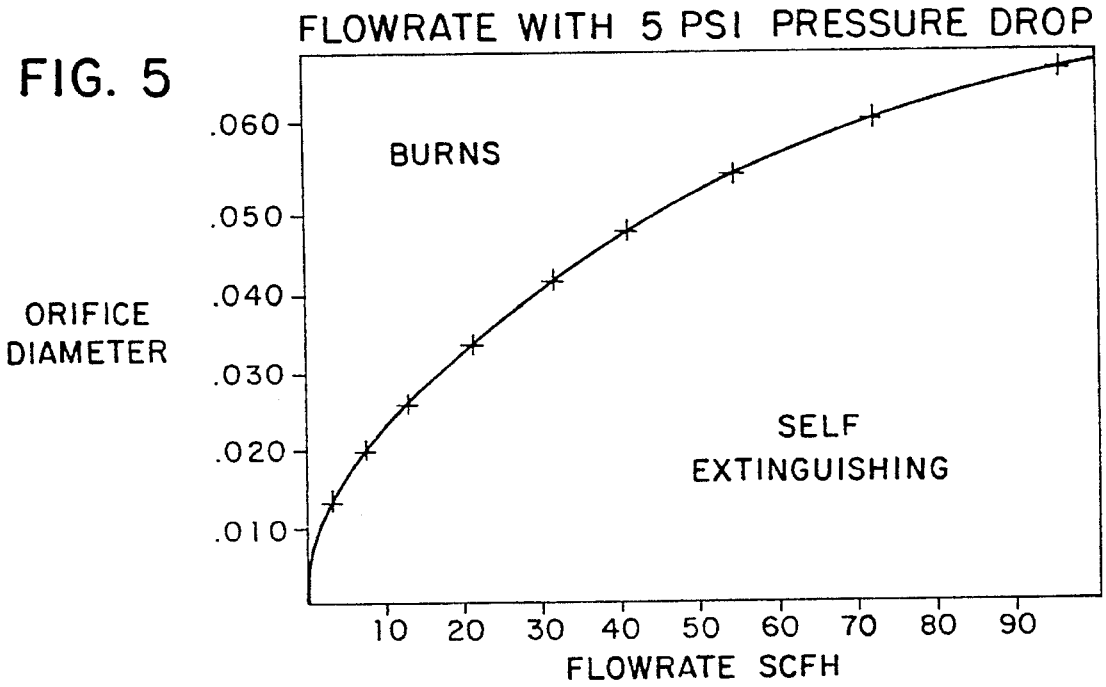

Reference will now be made to FIGS. 4 and 5 to explain how the size of the restricted orifice 10 and $\Delta P$ are selected. FIG. 4 is a graph plotting flow rate against orifice size and FIG. 5 is a graph plotting the flow rate against orifice diameter for a system in which a pressure difference $\Delta P$ between $R_1$ and $R_2$ is 5 psig. Both graphs were obtained by conducting numerous experiments in which various sizes of orifices were subjected to various pressure differentials to determine whether the gas emitted from the orifices ignited.

Referring to FIG. 4, a typical vehicle LNG tank has a 1.5 scfh relief flow rate. For a given flow rate any orifice sized below the line will be self-extinguishing and any orifice sized above the line will burn. For a flow rate of 1.5 scfh, any orifice smaller than 0.031 inches in diameter will be self-extinguishing while any orifice of greater diameter will burn. To provide a margin of safety it is desirable to select an orifice having a diameter somewhat smaller than the critical 0.031 inches.

Assume an orifice having a diameter of 0.025 inches is selected. Referring to FIG. 4, a 0.025 inch diameter orifice is self-extinguishing at a 0.9 scfh flow rate and this 0.9 scfh flow rate is 0.6 scfh below the actual relief flow rate of 1.5 scfh. Thus, an orifice size of 0.025 inches provides a safety margin in the flow rate of 0.6 scfh.

FIG. 5 is a graph plotting the flow rate against orifice diameter for a system in which a pressure difference $\Delta P$ between $R_1$ and $R_2$ is 5 psig. $\Delta P$ is selected based on the pressure required at the use device and the pressure at which emergency high flow venting is required.

For example, assume the use device requires a pressure of 200 psig and $R_1$ is selected to be 230 psig. $R_2$ is selected to be 235 psig such that $\Delta P=235-230=5$ psig. According to the graph of FIG. 5, the 0.025 inch diameter orifice (selected by reference to the graph of FIG. 4 as described above) provides a flow rate of 11.5 scfh at a 5 psig $\Delta P$. This maximum flow rate of 11.5 scfh is 10.0 scfh greater than the desired flow rate of 1.5 scfh providing a safety margin of 10 scfh. It should be noted that as the $\Delta P$ increases, the curve of FIG. 5 flattens such that for a given flow rate the orifice size decreases.

By properly selecting the orifice size and $\Delta P$, the system can operate for a wide range of flow rates to allow for self-extinguishing venting of the vapor. The graph of FIG. 4 can be reproduced for cryogens other than LNG via routine experimentation and the graph of FIG. 5 can be reproduced for delta pressures other than 5 psig. While the invention has been described with specific reference to LNG, it will be appreciated that similar arrangements could be used for venting other cryogenic liquid vapors.

While the invention has been described in some detail with respect to the drawings, it will be appreciated that numerous changes in the details and construction of the invention can be made without departing from the spirit and scope of the invention as set forth in the appended claims.

What is claimed is:

1. A storage system for a flammable cryogenic liquid, comprising:

a) a storage tank holding a quantity of flammable liquid cryogen and a vapor head;

b) means for delivering liquid cryogen from the tank; and c) means for venting flammable vapor from the tank when the pressure therein exceeds a first value, said venting means delivering vapor to atmosphere at a velocity exceeding the flame propagation rate of the vapor, whereby the vapor, if ignited, is self-extinguishing.

2. The storage system according to claim 1, wherein the liquid cryogen is LNG.

3. The storage system according to claim 1, wherein said storage tank is mounted on a vehicle.

4. The storage system according to claim 1, wherein the venting means includes a first vent line connecting the vapor head to the external atmosphere, said first vent line including a first relief valve that opens at said first pressure and a restricted orifice downstream from said first relief valve, said orifice being dimensioned to vent the vapor at not less than said velocity.

5. The storage system according to claim 4, further comprising a high volume vent line connecting the vapor head to the external atmosphere, said high volume vent line including a second relief valve that opens at a second, higher pressure value.

6. The storage system according to claim 4, further comprising a high volume vent line positioned in said first vent line between said first relief valve and said restricted orifice, said high volume vent line connecting the first vent line to the external atmosphere and including a second relief valve that opens at a second, higher pressure value.

7. The storage system according to claim 1, wherein said venting means comprises a first vent line connecting the vapor head to the external atmosphere, said first vent line including a first relief valve that opens at said first pressure value, said venting means further comprising a combination second relief valve and restricted orifice located in said first vent line downstream from said first relief valve, said second relief valve (a) opening at a second, higher pressure value, (b) allowing high volume flow to atmosphere when open and (c) creating flow through said restricted orifice at not less than said velocity when closed.

8. A storage system for a flammable cryogenic liquid, comprising:

a) a storage tank holding a quantity of flammable liquid cryogen and a vapor head;

b) first means for venting flammable vapor from the storage tank when the pressure therein exceeds a first value, said first vent means delivering said vapor to atmosphere at a velocity exceeding the flame propagation rate of said vapor, whereby the vapor, if ignited, is self-extinguishing; and c) second means for venting said vapor from said tank when the pressure therein exceeds a second, higher value.

9. The storage system according to claim 8, wherein the liquid cryogen is LNG.

10. The storage system according to claim 8, wherein said storage tank is mounted on a vehicle.

11. The storage system according to claim 8, wherein the first venting means includes a first vent line connecting the vapor head to the external atmosphere, said first vent line including a first relief valve that opens at said first pressure and a restricted orifice in said first vent line downstream from said first relief valve, said orifice being dimensioned to vent said vapor at not less than said velocity.

12. The storage system according to claim 11, wherein the second venting means includes a high volume vent line positioned in said first vent line between said first relief valve and said restricted orifice for connecting the first vent line to the external atmosphere, said high volume vent line including a second relief valve that opens at said second pressure.

13. The storage system according to claim 8, wherein the second venting means includes a high volume vent line connecting the vapor head to the external atmosphere, said high volume vent line including a second relief valve that opens at said second pressure.

* * * * *